US005999157A

United States Patent [19]

Ito et al.

[11] Patent Number: 5,999,157

[45] Date of Patent: Dec. 7, 1999

[54] SUPPRESSING LIQUID CRYSTAL MOVEMENT BASED ON THE RELATIONSHIP BETWEEN A DISPLAY PATTERN AND A DRIVING WAVEFORM

[75] Inventors: Nobuhiro Ito, Sagamihara; Yasuaki Takeda, Chigasaki; Hirohide Munakata, Yokohama; Yukio Hanyu; Yasufumi Asao, both of Isehara, all of Japan

[73] Assignee: Canon Kabushiki Kaisha, Tokyo, Japan

[21] Appl. No.: 08/770,267

[22] Filed: Dec. 20, 1996

[30] Foreign Application Priority Data

Dec. 27, 1995 [JP] Japan ..... 7-341100

[51] Int. Cl.[6] ..... G09G 3/36

[52] U.S. Cl. ..... 345/94; 345/87; 345/96; 345/98; 345/100

[58] Field of Search ..... 345/87, 94, 96, 345/98, 99, 100, 103, 104, 105

[56] References Cited

U.S. PATENT DOCUMENTS

| | | | |
|---|---|---|---|
| 4,367,924 | 1/1983 | Clark et al. | 350/334 |
| 4,836,287 | 6/1989 | Couste et al. | 166/321 |
| 5,082,587 | 1/1992 | Janulis | 252/299.01 |
| 5,109,294 | 4/1992 | Hanyu et al. | 359/83 |
| 5,293,544 | 3/1994 | Hanyu et al. | 359/78 |
| 5,317,332 | 5/1994 | Kanno et al. | 345/94 |
| 5,381,256 | 1/1995 | Hanyu et al. | 359/75 |
| 5,506,601 | 4/1996 | Mihara | 345/103 |
| 5,523,872 | 6/1996 | Hanyu et al. | 359/78 |
| 5,691,740 | 11/1997 | Onitsuke | 345/96 |
| 5,815,130 | 9/1998 | Taniguchi | 345/94 |
| 5,815,131 | 9/1998 | Taniguchi | 345/99 |

FOREIGN PATENT DOCUMENTS

| | | |
|---|---|---|
| 0550846 | 7/1993 | European Pat. Off. . |
| 0267638 | 5/1988 | France . |
| 56-107216 | 8/1981 | Japan . |
| 5273537 | 10/1993 | Japan . |
| 7-56176 | 3/1995 | Japan . |
| WO 9322396 | 11/1993 | WIPO . |

OTHER PUBLICATIONS

A.D.L. Chandani et al. "Tristable Switching in Surface Stabilized Ferroelectric Liquid Crystals with a large Spontaneous Polarization", Japanese Journal of Applied Physics, vol. 27, No. 5, May 1988, pp. L729–732.

Displays, vol. 11, No. 1, Jan. 1990, Guildford GB, pp. 30–35, XP000115912 N. Wakita et al.: "AC–field stabilized matrix ferroelectric LCD".

*Primary Examiner*—Vijay Shankar

*Attorney, Agent, or Firm*—Fitzpatrick,Cella, Harper & Scinto

[57] ABSTRACT

A liquid crystal apparatus comprises a liquid crystal device having a pair of substrates respectively having thereon scanning electrodes and data electrodes arranged in a matrix shape, and a liquid crystal disposed between the substrates and capable of a cumulative translational movement depending on a change in an external electric field applied to the liquid crystal; and a driver for controlling a first frequency f having a variable range and representing an effective frequency of a drive data signal pulse applied to the liquid crystal so that a second frequency $f_0$ representing an inversion frequency at which a direction of the translational movement of the liquid crystal is turned in an opposite direction is in the variable range of the first frequency f. The above driver used in the liquid crystal apparatus is effective in suppressing a cumulative translational movement of liquid crystal molecules for a long period of time.

7 Claims, 7 Drawing Sheets

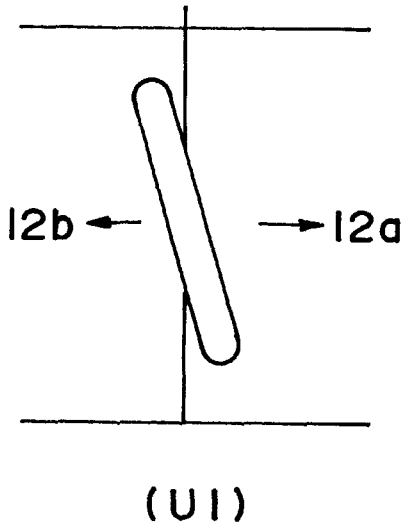
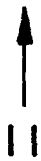
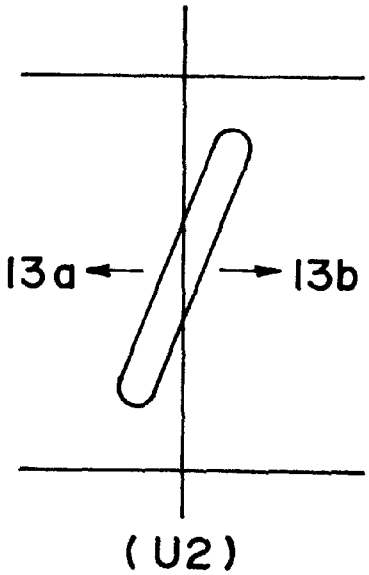
FIG. 1A
FIG. 1B

SUPPRESSING LIQUID CRYSTAL MOVEMENT BASED ON THE RELATIONSHIP BETWEEN A DISPLAY PATTERN AND A DRIVING WAVEFORM

FIELD OF THE INVENTION AND RELATED ART

The present invention relates to a liquid crystal apparatus including a liquid crystal device which may be used as a display device for a television receiver, a view finder for a video camera or a terminal monitor for a computer, or a light valve for a liquid crystal printer, a projector, etc., and a drive method of such a liquid crystal device.

A liquid crystal display device of a passive matrix drive-type using a TN (twisted nematic) liquid crystal has been known as a device which can be produced at a relatively low cost. However, the passive matrix-drive type liquid crystal device using a TN-liquid crystal has a certain limitation due to the occurrence of a crosstalk or a lowering in contrast along with the increase in number of drive lines so that it cannot be said to be suitable as a display device requiring a high resolution and a large number of drive lines, e.g., a liquid crystal television panel.

As a type of liquid crystal device having solved such a fundamental problem of a conventional TN-liquid crystal device, there has been proposed a surface-stabilized ferroelectric liquid crystal device (SSFLD) by Clark and Lagerwall (Japanese Laid-Open Patent Application (JP-A) 56-107216 corr. to U.S. Pat. No. 4,367,924). In the surface-stabilized ferroelectric liquid crystal device, a liquid crystal showing a chiral smectic phase, such as chiral smectic C (SmC*) phase or chiral smectic H (SmH*) phase, in its operational state is sandwiched between a pair of substrates with a small cell gap to exhibit a polarization domain peculiar to a ferroelectric material, thus realizing a high-speed responsiveness and bistability. In other words, the SSFLCD is one of chiral smectic liquid crystal devices. In the SSFLCD, chiral smectic liquid crystal molecules shows a property of assuming either one of two stable states responding to an electric field applied thereto and maintaining such a state in the absence of a sufficient electric field, namely bistability and a memory characteristic, and also has a quick responsiveness to the change in electric field.

By providing a liquid crystal device utilizing a switching of liquid crystal molecules between such a bistable state (two stable states), there has been made a considerably essential improvement on m any problems of a liquid crystal device using a conventional twisted nematic (TN) liquid crystal. Further, by using the SSFLCD together with polarizers, the SSFLCD is expected to be widely used as a display device showing a high-speed responsiveness and a memory characteristic.

In recent years, there has been also proposed a chiral smectic anti-ferroelectric liquid crystal device assuming three stable states (Chandani, Takezoe et al.; Japanese Journal of Applied Physics, Vol. 27, p. L729 (1988)).

As a driving method of the SSFLCD described above, a simple matrix-addressed drive scheme utilizing a memory characteristic is generally used. According to this scheme, in the SSFLCD, a plurality of scanning electrodes and a plurality of data electrodes are arranged in a matrix from in order to effect a multiplexing drive with respect to a chiral smectic liquid crystal. Specifically, a scanning signal is successively applied to the scanning electrodes in synchronism with application of a data signal to associated data electrodes.

In case where the above-mentioned liquid crystal device (SSFLCD) is driven by using such a simple matrix-addressed drive scheme, a data signal determining a display state is applied to data electrodes and a scanning signal designating a writing time (writing period) at a period (time cycle) determined by a duty factor with respect to a data signal pulse used is successively applied to scanning electrodes. A display state of each pixel in a selection period is determined in accordance with a combined (composite) signal of the scanning signal and the data signal. On the other hand, irrespective of a selection period and a non-selection period, each of pixels is always subjected to the influence of a change in electric field by a data signal application.

Liquid crystal molecules minutely vibrate on a cone (a cone-shaped plane on which liquid crystal molecules can be placed) within a degree not causing inversion by the interaction between the constantly varying electric field and a spontaneous polarization of liquid crystal molecules, whereby it has been clarified that a translational movement (uniform motion in one line or direction) of a center of gravity of liquid crystal molecules is induced. More specifically, as shown in FIGS. 1A and 1B each of liquid crystal molecules assumes either one of two stable state, i.e., a U1 state (FIG. 1A) or U2 state (FIG. 1B). The liquid crystal molecule in the U1 state shown in FIG. 1A is moved in a direction 12*a* or a direction 12*b* and the liquid crystal molecule in the U2 state shown in FIG. 1B is moved in a direction 13*a* or a direction 13*b*. These directions 12*a*, 12*b*, 13*a* and 13*b* are perpendicular to a direction 11 of a uniaxial aligning treatment (e.g., rubbing) axis. In the present invention, the directions 12*a* and 13*a* are taken as a positive direction in the U1 state and a positive direction in the U2 state respectively.

Due to the cumulative translational movement described above, the liquid crystal sandwiched between the substrates is accumulated at a peripheral portion of the device or an end portion of a writing region to increase a cell thickness (a thickness of the liquid crystal layer). As a result a retardation (a difference in phase based on birefringence) $\Delta nd$ is increased thus shifting a wavelength distribution of a transmitted light to a wavelength range assuming yellow (called "yellowing (phenomenon"). Due to this yellowing phenomenon resulting from a change in transmitted light spectrum, a display quality is lowered. In case where an amount of the increase in cell thickness decreased above becomes large, an effective electric field applied to the liquid crystal is lowered to cause a display unevenness within a display panel.

In order to minimize or suppress the above-described liquid crystal movement, there have been proposed several methods including: one utilizing a cell thickness-dependence of a liquid crystal movement degree (JP-A 7-56176), one utilizing a surface shape-dependence based on an uneven surfaced substrate (JP-A 5-273537), and one wherein an alignment state of a liquid crystal is changed correspondingly depending on a region (Japanese Patent Application No. 7-102221). In these methods, structural members or structural factors of a liquid crystal cell have been modified or controlled to solve the problem of liquid crystal movement.

However, according to our study, it has been clarified that a moving direction of a liquid crystal is changed by not only the structural members (factors) but also a liquid crystal material or driving conditions of a liquid crystal device, such as a drive temperature, a drive frequency and a drive voltage.

Further, a data signal applied to data electrodes is changed in its waveform pattern and frequency corresponding to a display state of a liquid crystal device. As described above, the liquid crystal movement is induced by a change in electric field of the applied data signal, so that the direction and amount of liquid crystal movement are changed correspondingly by a change of a display state or a display pattern.

Accordingly, in the case of designing a cell structure for the purpose of control of a liquid crystal movement phenomenon, it is necessary to effect an optimum designing of a liquid crystal cell (device) while also taking a display pattern and a driving waveform into consideration.

SUMMARY OF THE INVENTION

In view of the above-mentioned circumstances, an object of the present invention is to provide a liquid crystal apparatus including a liquid crystal device, particularly a chiral smectic liquid crystal device, in which a liquid crystal movement phenomenon is suppressed or minimized to prevent a yellowing phenomenon leading to a lowering in display quality and to provide a decreased display unevenness.

Another object of the present invention is to provide a liquid crystal apparatus including a liquid crystal device in which an amount of a liquid crystal movement is suppressed or minimized based on consideration of a relationship between a display pattern and a driving waveform.

A further object of the present invention is to provide a driving method for the liquid crystal device described above.

According to the present invention, there is provided a liquid crystal apparatus, comprising:

a liquid crystal device comprising a pair of substrates respectively having thereon scanning electrodes and data electrodes arranged in a matrix shape, and a liquid crystal disposed between the substrates and capable of causing a cumulative translational movement depending on a change in an external electric field applied to the liquid crystal; and drive means for controlling a first frequency f having a variable range and representing an effective frequency of a drive data signal pulse applied to the liquid crystal so that a second frequency $f_0$ representing an inversion frequency at which a direction of the translational movement of the liquid crystal is turned in an opposite direction is in the variable range of the first frequency f.

According to the present invention, there is also provided a driving method for a liquid crystal device of the type comprising a pair of substrates respectively having thereon scanning electrodes and data electrodes arranged in a matrix shape, and a liquid crystal disposed between the substrates and capable of causing a cumulative translational movement depending on a change in an external electric field applied to the liquid crystal; said driving method comprising:

controlling a first frequency f having a variable range and representing an effective frequency of a drive data signal pulse applied to the liquid crystal so that a second frequency $f_0$ representing an inversion frequency at which a direction of the translational movement of the liquid crystal is turned in an opposite direction is in the variable range of the first frequency f.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 1A and 1B are schematic views each showing an embodiment of a relationship between one stable state (U1 and U2) and a direction of movement with respect to chiral smectic (ferroelectric) liquid crystal molecules.

DESCRIPTION OF THE PREFERRED EMBODIMENTS

The present invention is based on a discovery that the direction of a cumulative translational movement of liquid crystal molecules is turned in an opposite direction at a certain (second) frequency ($f_0$) of a drive data signal pulse (hereinafter, sometimes referred to as "inversion frequency") even if the liquid crystal molecules are placed in any one of two stable states (U1 and U2 states as shown in FIG. 1).

Based on the above knowledge, we have found that when a liquid crystal device is driven by using an effective (first) frequency (f) of a drive data signal pulse having a variable range in which the inversion frequency ($f_0$) is present, it has become possible to effectively suppress the liquid crystal movement.

In a preferred embodiment of the present invention, a liquid crystal device used may adopt therein the conventional methods for preventing the liquid crystal movement as described above (e.g., cell gap control, the use of uneven substrate surface, and the use of suitable liquid crystal material).

In the present invention, when a third frequency $f_1$ satisfying an equation: $f_1=y\times 1/(1H)$ wherein y denotes a natural number satisfying a relationship of $z/2\leqq y\leqq(z+1)/2$ where z denotes the number of a change in sign (+or −) of data signal potential in a 1H period, and 1H denotes a selection period for one-line writing (a time required for one-line writing); the third frequency $f_1$ and the second frequency (inversion frequency) $f_0$ may preferably satisfy the following relationship:

$$0.5\times f_1\leqq f_0\leqq 1.5\times f_1.$$

Figure 2A:
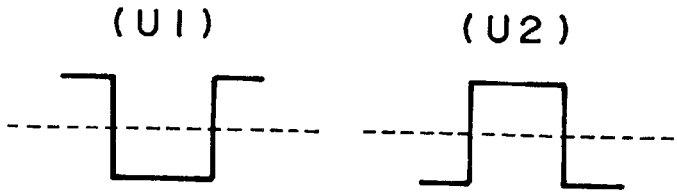
FIGS. 2AA–2AD and FIGS. 2BA–2BD are respectively an embodiment of a driving waveform of a data signal in one line writing period (1H) for providing a U1 state or a U2 state.
Figure 2A:
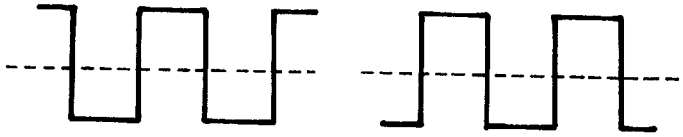
Figure 2A:
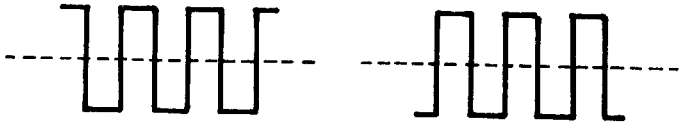
Figure 2A:
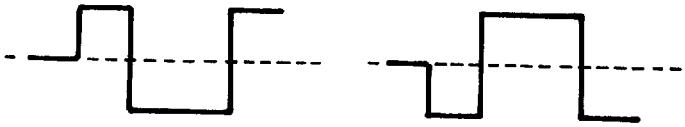
Figure 2B:
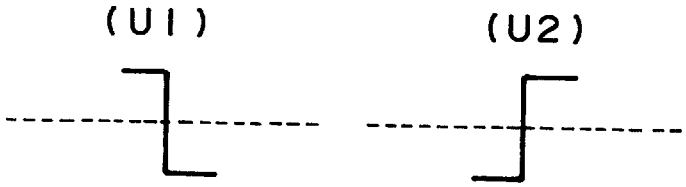
Figure 2B:
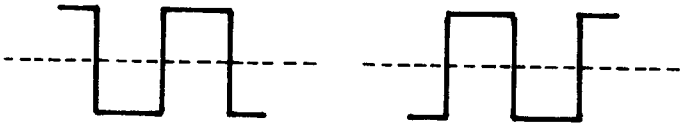
Figure 2B:
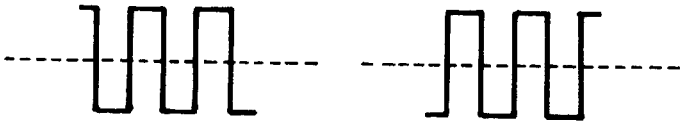
Figure 2B:
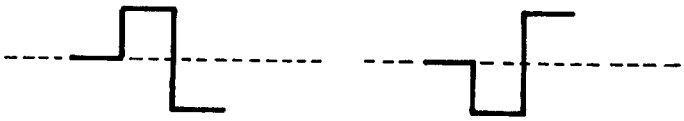

This relationship may preferably be adopted in case where the liquid crystal device is driven by a multiplexing driving scheme wherein a drive waveform unit of a data signal in a 1H period being an even-function waveform as shown in FIGS. 2AA–2AD and a drive waveform unit of a data signal in a 1H period being an odd-function waveform a shown in FIGS. 2BA–2BD are appropriately selected, as desired, in order to minimize a flickering phenomenon.

The third frequency $f_1$ also satisfies an equation: $f_1$=y× (frame frequency)/(duty factor). On the other hand, the second (inversion) frequency $f_0$ can be determined by effecting a drive test using an entire liquid crystal device or a part of the liquid crystal device in a manner described hereinafter.

Further, in case where the liquid crystal device is driven by a multiplexing driving scheme wherein a drive waveform unit of a data signal in a 1H period is an even-function waveform as shown in FIGS. 2AA–2AD, the second and third frequencies $f_0$ and $f_1$ may preferably satisfy the following relationship:

$$f_1 \leqq f_0 \leqq 1.5 \times f_1.$$

Further, in case where the liquid crystal device is driven by a multiplexing driving scheme wherein a drive waveform unit of a data signal in a 1H period is an odd-function waveform as shown in FIGS. 2BA–2BD, the second and third frequencies $f_0$ and $f_1$ may preferably satisfy the following relationship:

$$0.5 \times f_1 \leqq f_0 \leqq f_1.$$

Herein, the even-function waveform means a drive signal waveform having an even-numbered z (z: the number of change in sign of data signal potential in a 1H period as defined above) as shown in FIGS. 2AA–2AD and the odd-function waveform means a drive signal waveform having an odd-numbered z as shown in FIGS. 2BA–2BD. For example, a data signal waveform for providing a U1 state shown in FIG. 2A (even-function waveform) include a change in sign of data signal potential: (+)→(−)→(+), thus resulting in the number of sign change being 2 (even number).

By using a drive means capable of controlling frequencies of data signal pulse so as to satisfy the relationships between the first and second frequencies (f and $f_0$) and between the second and third frequencies ($f_0$and $f_1$) described above, it is possible to provide a liquid crystal apparatus, using a chiral smectic liquid crystal device with a high reliability and a minimized display irregularity accompanied with a cell thickness increase in a panel even if a display pattern is changed.

According to our study, we have confirmed that the liquid crystal movement is affected by various factors, such as a frequency, a voltage and a bias ratio of a drive waveform but the direction of liquid crystal movement is largely affected by the frequency of the drive waveform used. We have also found that the inversion frequency $f_0$ is liable to be changed by a cell thickness, a surface shape (e.g., uneven shape) of substrates, a pretilt angle, a material for an alignment control film, a liquid crystal material, temperature, etc. Accordingly, in order to control a moving rate of a liquid crystal so as not to cause a cell thickness change (increase), it is necessary to effect a temperature control with respect to a drive frequency even if the above structural members (or structural factors) are optimally selected.

However, in case where a writing state is controlled by a simple matrix-addressed drive scheme, the drive frequency is fixed with respect to temperature, a frequency of a data signal is changed under the influence of a writing pattern of data electrodes. In view of this point, it is important to determine a drive frequency.

As shown in FIG. 1, a positive moving direction 12*a* (or 13*a*) in a U1 state (or a U2 state) is parallel with a direction of a liquid crystal layer uniaxially oriented and these positive moving directions 12*a* (in the U1 state) and 13*a* (in the U2 state) are opposite to each other. Further, in case where one of two stable states (U1 and U2 states) is continuously provided in the layer direction by appropriately selecting a drive waveform, the directions of movement of respective liquid crystal molecules are not counterbalanced with each other within a liquid crystal panel (display region). As a result, many of the liquid crystal molecules are localized or accumulated at an end portion of the liquid crystal layer, thus resulting in a considerable increase in cell thickness. This phenomenon is noticeable in the case of performing a uniaxial aligning treatment so that a liquid crystal layer is formed in a direction of a diagonal line of a rectangular display panel since a writing length in the layer direction becomes maximum.

According to our study, an occurrence of the liquid crystal movement phenomenon does not necessarily require an inversion of liquid crystal molecules from one stable state to the other stable state because the phenomenon is induced by a minute vibration electric field not causing the inversion of a stable state. Accordingly, the liquid crystal movement phenomenon may be attributable to an amplitude of a data signal exerted on liquid crystal molecules within pixels in a non-selection period of a scanning signal. For this reason, in a certain place of the liquid crystal layer, a data signal is correspondingly changed by a change in display pattern in an extension direction of an electrode to which a data signal is applied (i.e., a data electrode) even if one-line writing period is fixed, thus causing a change in frequency. Consequently, a liquid crystal movement characteristic at this time is also changed.

A tendency of the change in frequency in the data electrode direction is different between two types of a data signal waveform unit as follows.

In case where a drive waveform unit of a data signal in a 1H period is an even-function (or almost even-function) waveform as shown in FIGS. 2AA–2AD wherein a first constituent waveform for the former H/2 period and a second constituent waveform for the latter H/2 period are substantially symmetric with respect to a vertical line drawn to across a point representing a lapse of the former H/2 period, a frequency of the data signal is increased when a boundary between U1 and U2 states is increased in a writing pattern in the direction of a data electrode.

In this case, the frequency is changed by a maximum of 1.5 times its lowest value. In other words, the first frequency (effective frequency of the data signal pulse) f is changed within a range of $f_1$ to 1.5 $f_1$ ($f_1$: third frequency) depending on a change in the writing pulse in the data electrode direction.

In case where a drive waveform unit of a data signal in a 1H period is an odd-function (or almost odd-function) waveform as shown in FIGS. 2BA–2BD wherein a first constituent waveform for the former H/2 period and a second constituent waveform for the latter H/2 period are substantially symmetric with respect to a point representing a lapse of the former H/2 period, a frequency of the data signal is decreased when a boundary between U1 and U2 states is increased in a writing pattern in the direction of a data electrode.

In this case, the frequency is changed by a maximum of 0.5 time its highest value. In other words, the first frequency (effective frequency of the data signal pulse) f is changed within a range of 0.5 $f_1$ to $f_{1\ (f1}$: third frequency) depending on a change in the writing pulse in the data electrode direction.

As described above, in order to suppress flickering, it is possible to use the even-function waveform and the odd-function waveform in combination. In this case, the first frequency f is changed within a range of 0.5 $f_1$ to 1.5 $f_1$.

The above property, i.e., a writing pattern-dependence in the data electrode direction of the first frequency f becomes large with an increase in the number of pixels in the data electrode direction (i.e., the number of division of a display region in the data electrode direction). Accordingly, this tendency is more pronounced in case where directions of a data electrode and a liquid crystal layer normal are closer to each other.

Hereinbelow, a preferred embodiment of a liquid crystal device used in the present invention will be described more specifically with reference to FIG. 3.

Figure 3:
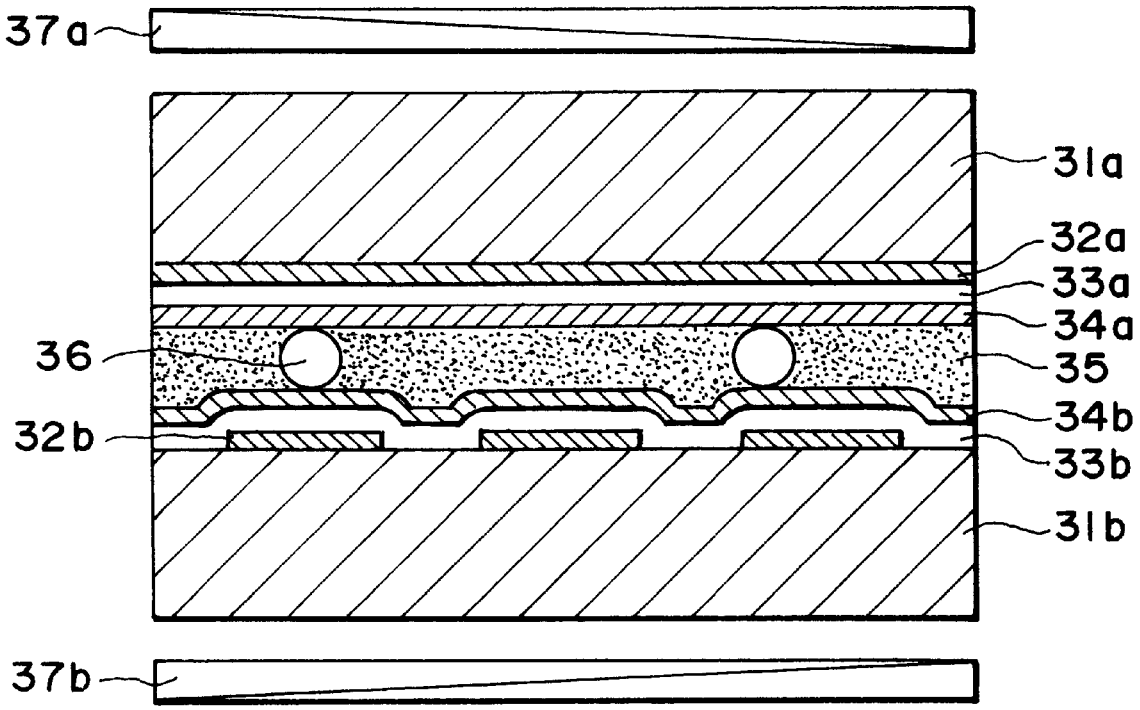
FIG. 3 is a schematic sectional view of an embodiment of a liquid crystal device used in the present invention.

FIG. 3 shows a schematic sectional view of an embodiment of a chiral smectic liquid crystal device.

Referring to FIG. 3, a pair of substrates 31*a* and 31*b* are coated with ca. 40–300 nm-thick transparent electrodes 32*a* and 32*b*, e.g., comprising oxides, such as tin oxide, indium oxide and indium-tin oxide (ITO). On the transparent electrodes 32*a* and 32*b*, ca. 10–300 nm-thick insulating films 33*a* and 33*b* for preventing a short circuit between the substrates are formed. The insulating films 33*a* and 33*b* comprise oxides, such as ZnO, ZrO and TaOx and either one or both of which may be omitted, as desired. Each of the insulating films 33*a* and 33*b* may be formed in a single layer, e.g., formed by wet coating and hot curing or in a plural layers wherein, e.g., an upper layer is formed on a lower layer by sputtering. On the insulating films 33*a* and 33*b* (or the transparent electrodes 32*a* and 32*b*), alignment control films 34*a* and 34*b* are formed in a thickness of ca. 5–100 nm. At least one of the alignment control films 34*a* and 34*b* may preferably comprise a film of an organic polymer, such as nylon or polyimide, which has been subjected to a uniaxial aligning treatment, such as rubbing. One of the alignment control films 34*a* and 34*b* may be a film of, e.g., polysiloxane, which has not been subjected to a uniaxial aligning treatment. In order to provide the alignment control films with a stable uneven surface, fine particles may be incorporated into the insulating films and/or the alignment control films. The thus treated substrates 31*a* and 31*b* are applied to each other with a prescribed spacing by using spacer beads 36, adhesive beads (not shown) and a sealing agent (not shown), as desired. Into the spacing, a chiral simectic liquid crystal 35, preferably a ferroelectric liquid crystal assuming bistability or an antiferroelectric liquid crystal assuming three stable states is filled to form a liquid crystal cell. Outside the liquid crystal cell, a pair of polarizers 37*a* and 37*b* are disposed.

In an effective optical modulation region (or display region) of the liquid crystal device, liquid crystal molecules may preferably provide a pretilt angle of at least 10 degrees or of at most 5 degrees.

The chiral smectic liquid crystal 35 may prefer ably be formulated as a chiral smectic liquid crystal composition consisting of at least one species of a phenylpyrimidine-based liquid crystal material and a chiral podant. The chiral smectic liquid crystal 35 may preferably assume a chiral smectic state, such as chiral smectic C (SmC*) phase, chiral smectic H (SmH*) phase, chiral smectic I (SmI*) phase, chiral smectic K (SmK*) phase or chiral smectic G (SmG*) phase, preferably SmC* phase, in its operational state.

In a particularly preferred embodiment of the present invention, the chiral smectic liquid crystal 35 has cholesteric (Ch) phase and smectic A (SmA) phase at a higher temperature side of SmC* phase. In such a liquid crystal, when the liquid crystal is gradually cooled from isotropic phase (Iso.), a direction of liquid crystal molecules (long axis direction) is uniformly directed in one direction in Ch phase and in SmA phase, a layer structure extending in a direction perpendicular to the liquid crystal molecule direction is formed and then in SmC* phase, the liquid crystal molecule direction is tilted or inclined with respect to the original direction thereof, thus resulting in a uniform alignment state because of successive formation of plural orders as to liquid crystal molecules. For this reason, a pyrimidine-based liquid crystal mixture A (used in Experimental Examples 1–7 appearing hereinafter) having the following phase transition series and physical properties may suitably be used.

Phase Transition Temperature (° C.)

$$\text{Cryst.} \underset{-8.1}{\overset{-13.5}{\rightleftharpoons}} \text{SmC}^* \xrightarrow{66.4} \text{SmA} \xrightarrow{89.0} \text{Ch.} \xrightarrow{96.1} \text{Iso.}$$

Cryst.: crystal phase

Tilt angle (at 30° C.)=14.8 degrees

Layer inclination angle (at 30° C.)=10.2 degrees

Spontaneous polarization (at 30° C.)=6.3 nC/$cm^2$

In the present invention, the chiral smectic liquid crystal 35 may have another phase transition series, e.g., lacking Ch phase. Examples of the liquid crystal material lacking Ch phase may include a liquid crystal composition containing at least one species of a fluorine-containing liquid crystal compound as disclosed in U.S. Pat. No. 5,082,587, WO-A 93/22396, etc.

The liquid crystal device described above is used a a display element (medium of the liquid crystal apparatus of the present invention, one embodiment of which is described below.

The liquid crystal apparatus generally includes a graphic controller, the above-described liquid crystal device as a display panel, a scanning line drive means (circuit) providing a scanning signal, a data line drive means (circuit) providing a data signal, a decoder, a scanning signal generator, a shift resistor, a line memory, a data signal generator, a drive control circuit, a graphic central processing unit (GCPU), a host central processing unit (host CPU), and an image data storage memory (VRAM).

Image data are generated in the graphic controller in an apparatus body and transferred to the display panel by signal transfer means. The graphic controller principally comprises a GCPU and a VRAM and is in charge o management and communication of image data between a host CPU and the liquid crystal display apparatus. The control of the display apparatus is principally performed by the graphic controller. A light source is disposed behind the display panel.

When the liquid crystal apparatus of the present invention employs a chiral smectic liquid crystal device as a display panel (medium), the liquid crystal apparatus exhibits excellent drive characteristics and reliability and provides high-definition and large-area display images at high speed.

Hereinbelow, the present invention will be described in more detail with reference to Experimental Examples.

In the following experimental examples, evaluation of a moving rate of liquid crystal molecules and a cell thickness increase is performed in the following manner.

Liquid Crystal Moving Rate

Figure 4A:
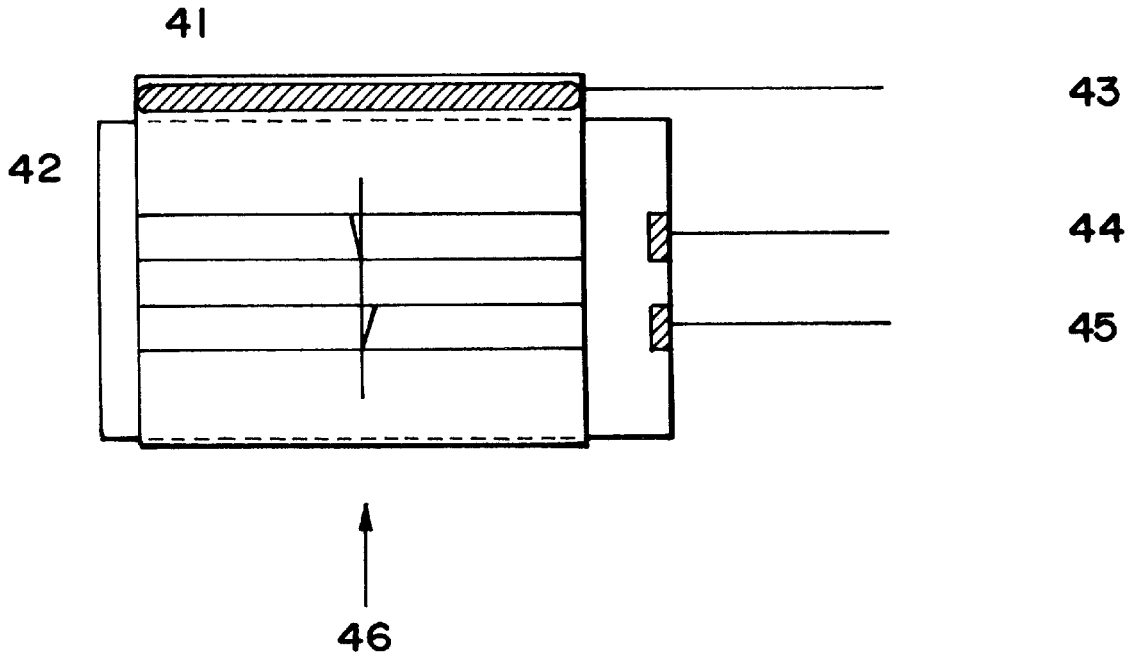
FIGS. 4A and 4B are respectively a schematic plan view showing an embodiment of a liquid crystal cell for measuring a moving rate of liquid crystal molecules.

FIG. 4A shows a liquid crystal cell for measuring a moving rate of liquid crystal molecules, wherein an upper substrate 41 is connected with a data line (electrode) 43 and a lower substrate 42 is connected with scanning lines (electrodes) 44 and 45. A plurality of elongated liquid crystal layers are perpendicular to a layer normal direction 46 determined by a uniaxial aligning axis in advance.

Figure 5:
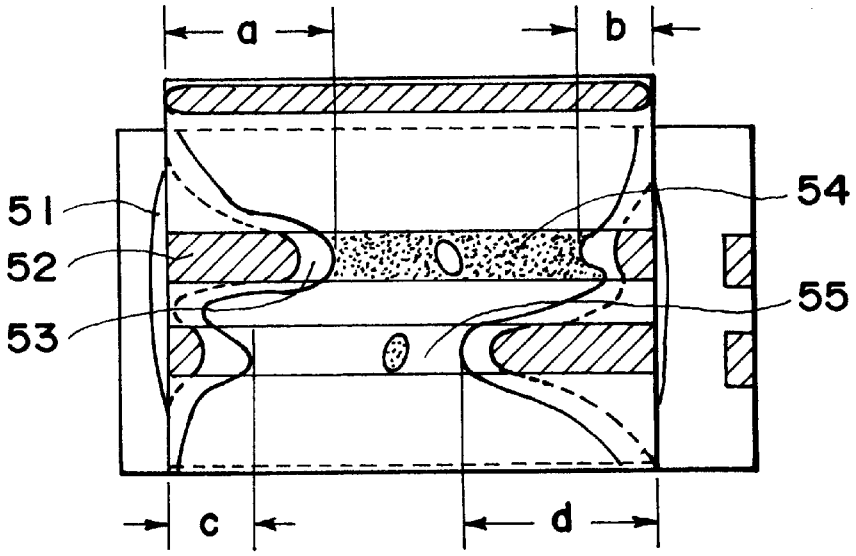
FIG. 5 is a schematic plan view showing an embodiment of a liquid crystal movement phenomenon.

In the above cell, a sealing agent is disposed on parallel two sides perpendicular to the layer normal of four sides of rectangular-shaped sealing region of a liquid crystal material. Into the sealing region, a chiral smectic liquid crystal is filled and at each of openings of both end portions of the sealing region, an about 1 mg of a nematic liquid crystal 51 ("ZLI-1132", manufactured by Merck Co.) is applied to prepare a sample liquid crystal cell as shown in FIGS. 4A and 5.

Then, the sample liquid crystal cell is driven under desired drive conditions, such as a temperature, a drive waveform, a drive voltage and a drive frequency. During the drive of the liquid crystal cell, a liquid crystal movement phenomenon of the chiral smectic liquid crystal is observed. More specifically, as shown in FIG. 5, the nematic liquid crystal 51 disposed at the end portions is caused to enter the inside of the sealing region (toward the center thereof) to provide an SmA phase portion 53 and a nematic (N) phase portion 52. After a lapse of a prescribed time (e.g., 10 Hr), distances a, b, c and d (mm) each from the corresponding opening edge to the corresponding boundary between the SmC* phase portion 54 (or 55) and the SmA phase portion 53 (or between the SmA phase portion 53 and the N phase portion 52) as shown in FIG. 5 are measured to determine a moving rate X1 of the liquid crystal in a U1 state and a moving rate X2 of the liquid crystal in a U2 state according to the following equations (1) and (2), respectively.

$$X1(\text{mm}/10\text{h})=(a(\text{mm})-b(\text{mm}))/10(h) \quad (1),$$

$$X2(\text{mm}/10\text{h})=(d(\text{mm})-c(\text{mm}))/10(h) \quad (2).$$

In order to preclude the influence of natural diffusion of the nematic liquid crystal, a difference between the associated two distances (a and b or d and c) is adopted in the present invention.

Figure 6:
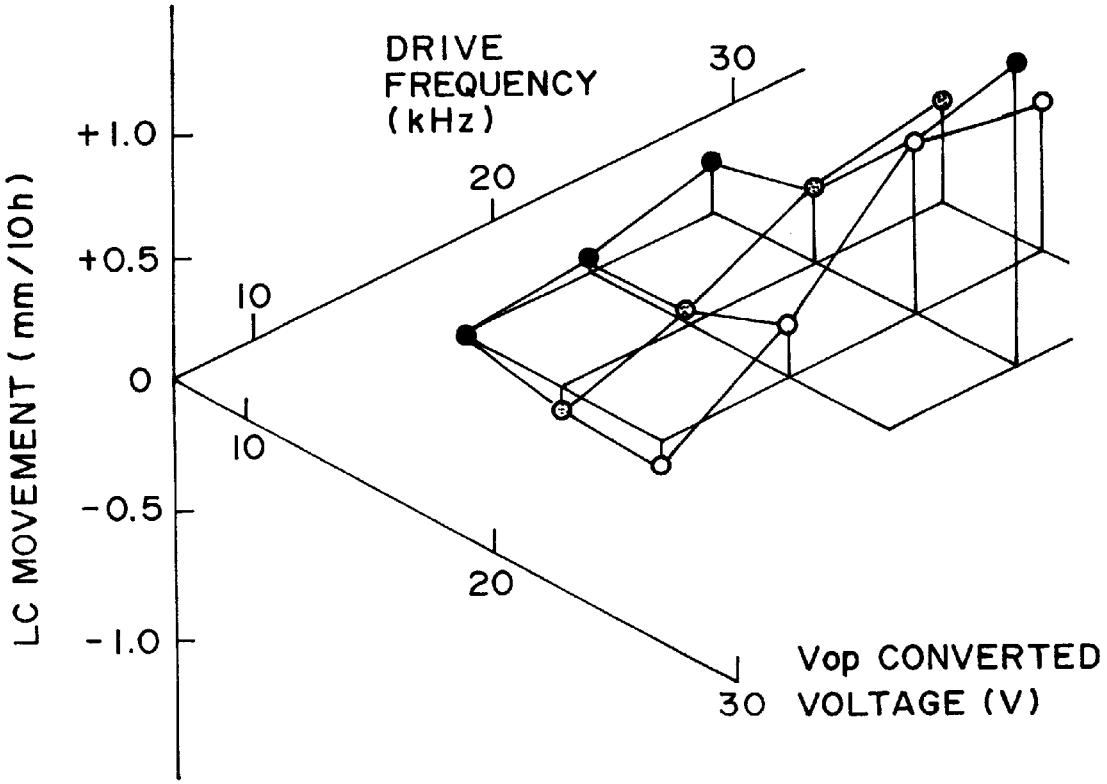
FIG. 6 is a graph for illustrating a voltage-dependence of a liquid crystal moving rate and a frequency-dependence of the liquid crystal moving rate.

According to the above method, a moving rate of the above-mentioned pyrimidine-based liquid crystal mixture A is measured while appropriately changing a voltage (writing pulse peak value corr. to Vop converted voltage) and a drive frequency. The result is shown in FIG. 6. As apparent from FIG. 6, it is confirmed that the direction of the liquid crystal movement is not readily affected by the applied voltage but is largely affected by the drive frequency. In this measurement, a sample cell has a size of 25 mm (in layer extension direction)×20 mm (in layer normal direction) and a measurement temperature is 40° C.

Figure 4B:
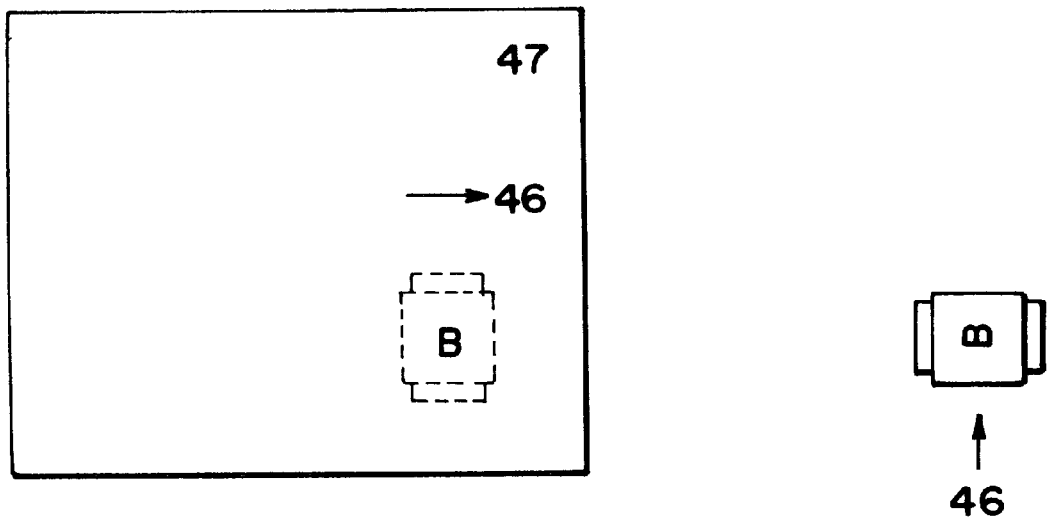

In place of the above-described sample cell for measurement, a part B of a liquid crystal cell 47 including a liquid crystal shown in FIG. 4B may be used by cutting the part B and providing the part B with openings and electrode terminals similarly as in the sample cell shown in FIG. 4A.

Cell Thickness Increase

Figure 7:
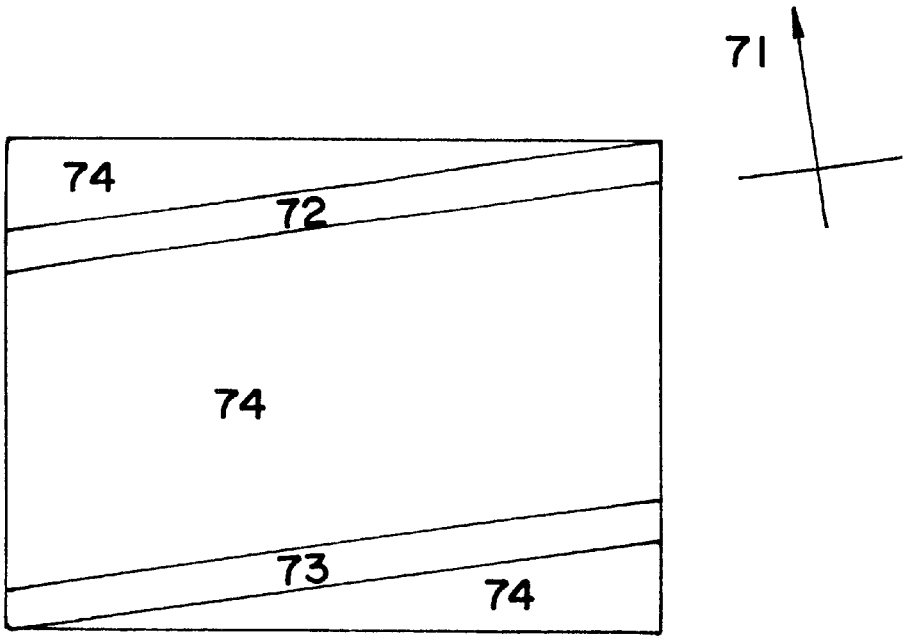
FIG. 7 is a schematic sectional view of a display pattern for evaluating a cell thickness change in a durability test.

FIG. 7 shows a schematic plan view of a sample liquid crystal cell for measuring an increase in cell thickness in a durability test (continuous drive).

Referring to FIG. 7, a 20 mm-width elongated region (U1 state) 72 displaying a black (BL) state and a 20 mm-width elongated region (U2 state) 73 displaying a white (W) state are provided in parallel with scanning electrodes crossing data electrodes at right angles. In this case, the data electrodes are parallel with a layer normal direction 71 and the scanning electrodes are parallel with a layer extension direction (perpendicular to the layer normal direction 71). In other regions 74, a white (W)-and-black (BL) stripe pattern is continually displayed in a prescribed display time cycle as shown in FIG. 8 wherein 640 scanning lines are divided into those displaying U1 (BL) state and those displaying U2 (W) state each linearly varying (increasing or decreasing) in the number thereof with time (one display time cycle=4 h).

Figure 8:
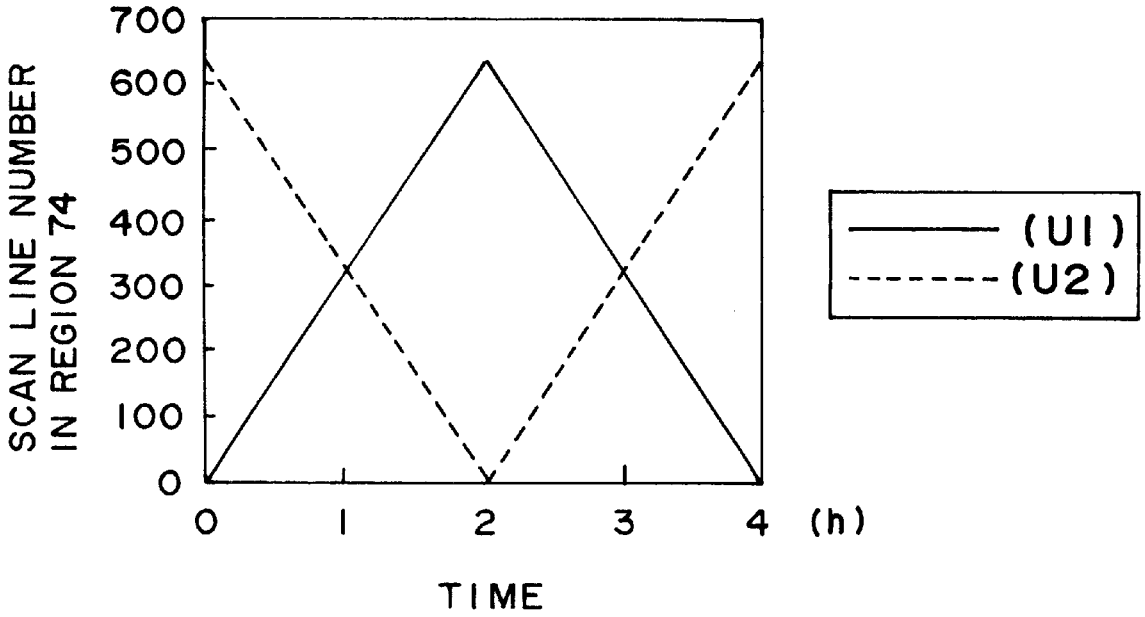
FIG. 8 is a graph for illustrating a change in number of scanning lines with time in a region 74 shown in FIG. 7.

For example, a sample liquid crystal cell having 800 scanning lines (electrodes) and a length in the data electrode direction of 200 mm is driven at a frame frequency of 12.5 Hz in a non-interlaced driving scheme and in the display time cycle shown in FIG. 8. In this instance, when the number of scanning lines providing BL (U1) state reaches 320 lines, then the number of a boundary between the BL (U1) and W (U2) states (display regions) becomes maximum. At this time a frequency (effective frequency f) of a data signal (pulse) is changed from 10 kHz to 14 kHz in the case of using a drive data signal waveform shown in FIG. 2AA and is changed from 10 kHz to 6 kHz in the case of using a drive data signal waveform shown in FIG. 2BA.

While driving the sample liquid crystal cell in the above-described manner, a cell thickness change with time is measured at four measuring points corresponding to four end portions of the regions 72 and 73 to obtain a durability time $T_{(0.05\ \mu m)}$ (hours) from the start of drive until a cell thickness increment of 0.05 $\mu$m is confirmed.

The cell thickness increase is evaluated in terms of a $T_{(0.05\ \mu m)}$ at an end portion at which the cell thickness increment of 0.05 $\mu$m is first confirmed among the above-mentioned four end portions.

In the above evaluation, the layer extension direction and the scanning electrode direction are parallel to each other but may intersect with each other as long as the two direction are not perpendicular to each other. In this instance, the width (20 mm) of the elongated regions 72 and 73 are taken in the data electrode direction and the length (200 mm) in data electrode of the cell does not coincide with that in the layer normal direction.

EXPERIMENTAL EXAMPLE 1

Two 1.1 mm-thick glass substrates were coated with ca. 150 nm-thick ITO films by sputtering, which were then patterned into stripe electrodes (transparent electrodes) of ca. 250 $\mu$m in pixel pitch by using a photolithographic process. Each of the stripe electrodes were then coated with a 6 wt. % solution of an insulating material (containing Ti:Si=1:1) containing silica fine particles of ca. 30 nm in average diameter dispersed therein by using an extended plate of 5 $\mu$m in roughness, followed by prebaking at 100° C. for a. 10 min., UV irradiation and baking for ca. 1 hour at 300° C., to form a ca. 20 nm-thick insulating film.

Then, each of alignment control films was formed on the associated insulating film by applying a 1.5 wt. % solution of polyamide acid ("LQ 1802", available from Hitachi Kasei K.K.) in a NMP (N-methylpyrrolidone)/nBC (n-butyl cellosolve) (=1/1) mixture solvent by spin coating under a spinner speed of 2000 rpm for 20 sec., followed by baking at 270° C. for 1 hour to obtain a ca. 20 nm-thick alignment control film.

Then, each substrate was rubbed in one direction with a nylon fiber-planted cloth under the conditions of a pressing depth $\epsilon$ of 0.35 mm, a roller rotation speed of 1000 rpm and a roller feed rate of 30 mm/sec.

On one of the substrates, silica beads having an average diameter of ca. 1.5 $\mu$m were dispersed.

The other substrate was superposed on the above substrate and applied to each other so that their rubbing direction (rubbing axes) were parallel to each other and in an identical direction and that the stripe electrodes on the substrates were arranged in a matrix shape to prepare a blank cell $A_0$ having a size of 200 mm (in data line extension direction)×250 mm (scanning line extension direction) and pixels of 800×1000.

Similarly as in the above-described manner, another blank cell was prepare and subjected to cutting to prepare fine blank cells $A_1$, $A_2$, $A_3$, $A_4$ and $A_5$ each having a size of 15 mm×25 mm and provided with two openings.

Into each of the thus prepared blank cells $A_0$ and $A_1$ to $A_5$, a pyrimidine-based liquid crystal mixture A described above was injected in an isotropic liquid state under reduced pressure (or in vacuum condition) and was gradually cooled to room temperature at a rate of 0.5° C./min., thus providing uniaxial aligned liquid crystal molecules in a chiral smectic C (SmC*) phase.

Each of the thus prepared liquid crystal cells (devices) $A_1$ to $A_5$ (for measurement of liquid crystal moving rate) was subjected to electrical connection so as to drive (or actuate) 4 mm-width stripe regions (first and second regions) at the same time and then was supplied with a single pulse of +5 V for first region (or −5 V for second region) in a period of 100 msec to provide a white state for first region (or a black state f or second region) as a memory state. To the liquid crystal cells $A_1$ to $A_5$, a data signal (pulse) with a frequency (third frequency $f_1$: fixed) of 8–25 kHz (for the cells $A_1$ (8 kHz) to $a_5$ (25 kHz)) was applied at 40° C. by using a drive means to measure a moving rate of liquid crystal molecules in the above-described manner.

As a result, an inversion frequency (second frequency $f_0$) of 15 kHz was obtained.

Figure 9:
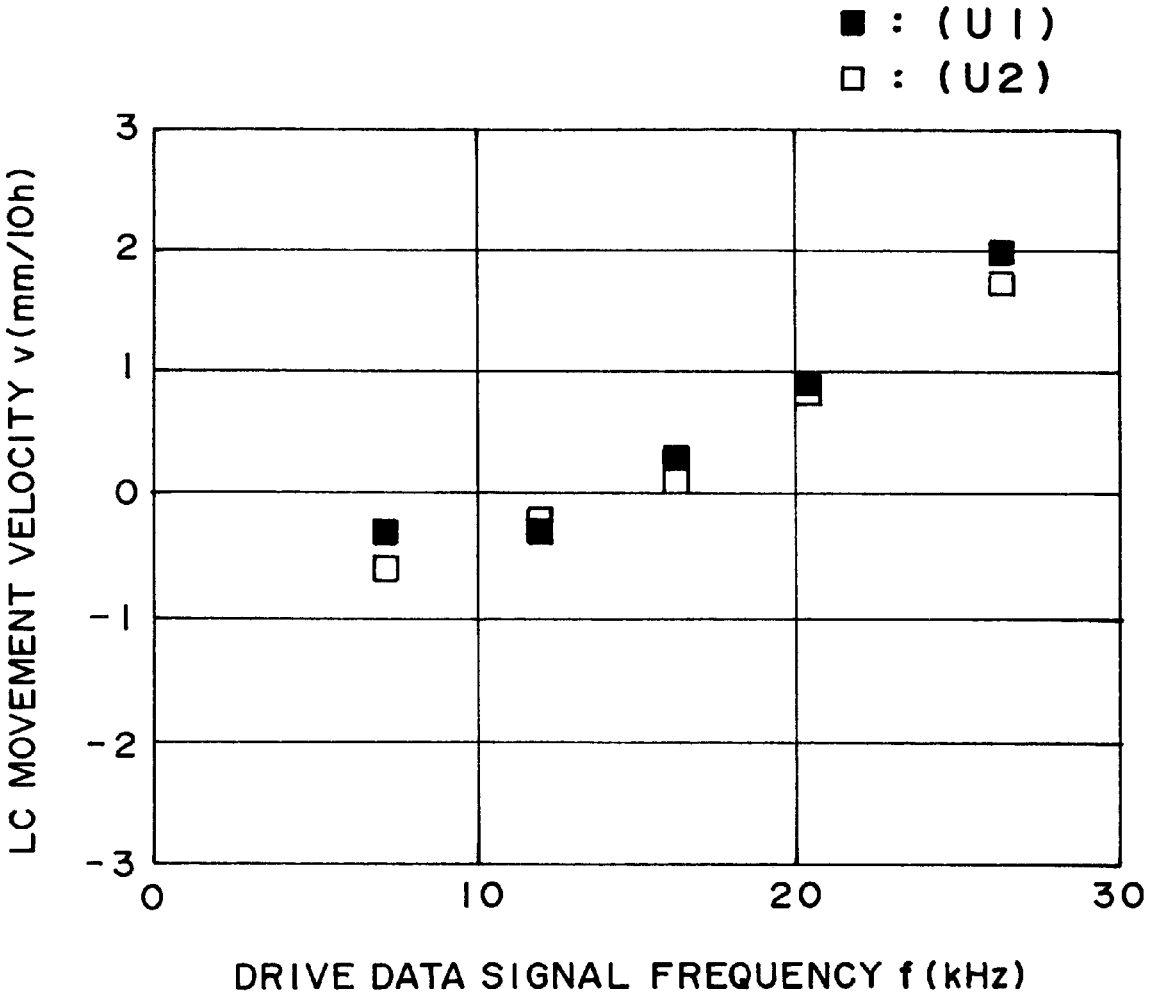
FIG. 9 is a graph showing a relationship between a liquid crystal moving rate an a drive data signal frequency in Experimental Example 1 appearing hereinafter.

The liquid crystal movement characteristic (relationship between a drive data signal waveform and a moving rate) in this experimental example was shown in FIG. 9.

On the other hand, the liquid crystal cell $A_0$ (for measurement of $T_{(0.05\ \mu m))}$ was driven at a frame frequency of 17.5 Hz in accordance with a non-interlaced driving scheme in a temperature-controlled chamber (40° C.). More specifically, the liquid crystal cell $A_0$ was subjected to continuous writing with an even-function waveform shown in FIG. 2AA (1H=71 μsec) in the display time cycle shown in FIG. 7 and in the above-described manner, whereby a durability time $T_{(0.05\ \mu m)}$ of 2497 hours was obtained. Further, a frequency (third frequency $f_1$) at the time of writing an entire white (or black) state was 14 kHz.

EXPERIMENTAL EXAMPLE 2

Six liquid crystal cells $B_0$ and $B_1$ to $B_5$ were prepared and evaluated in the same manner as in Experimental Example 1 except that the frame frequency (17.5 Hz) was changed to 20.0 Hz and the even-function waveform (FIG. 2AA) was changed an odd-function waveform shown in FIG. 2BA.

As a result, a second frequency $f_0$ of 15 kHz, a third frequency $f_1$ to 16 kHz and a $T_{(0.05\ \mu m)}$ of 2143 hours were obtained.

EXPERIMENTAL EXAMPLE 3

Six liquid crystal cells $C_0$ and $C_1$ to $C_5$ were prepared and evaluated in the same manner as in Experimental Example 1 except that the even-function waveform (FIG. 2AA) was changed an even-function waveform shown in FIG. 2AD.

As a result, a second frequency $f_0$ of 15 kHz, a third frequency $f_1$ to 14 kHz and a $T_{(0.05\ \mu m)}$ of 2310 hours were obtained.

EXPERIMENTAL EXAMPLE 4

Six liquid crystal cells $D_0$ and $D_1$ to $D_5$ were prepared and evaluated in the same manner as in Experimental Example 1 except that the frame frequency (17.5 Hz) was changed to 20.0 Hz.

As a result, a second frequency $f_0$ of 15 kHz, a third frequency $f_1$ to 16 kHz and a $T_{(0.05\ \mu m)}$ of 814 hours were obtained.

EXPERIMENTAL EXAMPLE 5

Six liquid crystal cells $E_0$ and $E_1$ to $E_5$ were prepared and evaluated in the same manner as in Experimental Example 1 except that the frame frequency (17.5 Hz) was changed to 21.3 Hz and the even-function waveform (FIG. 2AA) was changed an even-function waveform shown in FIG. 2AD.

As a result, a second frequency $f_0$ of 15 kHz, a third frequency $f_1$ to 17 kHz and a $T_{(0.05\ \mu m)}$ of 485 hours were obtained.

EXPERIMENTAL EXAMPLE 6

Six liquid crystal cells $F_0$ and $F_1$ to $F_5$ were prepared and evaluated in the same manner as in Experimental Example 1 except that the even-function waveform (FIG. 2AA) was changed an odd-function waveform shown in FIG. 2BA.

As a result, a second frequency $f_0$ of 15 kHz, a third frequency $f_1$ to 14 kHz and a $T_{(0.05\ \mu m)}$ of 310 hours were obtained.

EXPERIMENTAL EXAMPLE 7

Six liquid crystal cells $G_0$ and $G_1$ to $G_5$ were prepared and evaluated in the same manner as in Experimental Example 1 except that the frame frequency (17.5 Hz) was changed to 28.8 Hz and the even-function waveform (FIG. 2AA) was changed an even-function waveform shown in FIG. 2BA.

As a result, a second frequency $f_0$ of 15 kHz, a third frequency $f_1$ to 23 kHz and a $T_{(0.05\ \mu m)}$ of 132 hours were obtained.

The results of Experimental Examples 1–7 are also summarized in Table 1 shown below.

TABLE 1

| Ex. No. | $f_0$ (kHz) | $f_1$ (kHz) | Waveform (even or odd) | $T_{(0.05\ \mu m)}$ (hours) |
|---|---|---|---|---|
| 1 | 15 | 14 | FIG. 2AA (even) | 2497 |
| 2 | 15 | 16 | FIG. 2BA (odd) | 2143 |
| 3 | 15 | 14 | FIG. 2AD (even) | 2310 |
| 4 | 15 | 16 | FIG. 2AA (even) | 814 |
| 5 | 15 | 17 | FIG. 2AD (even) | 485 |
| 6 | 15 | 14 | FIG. 2BA (odd) | 310 |
| 7 | 15 | 23 | FIG. 2AA (even) | 132 |

As apparent from the above results, by appropriately controlling a combination of a data signal waveform and a data signal frequency, it is possible to effectively suppress a cell thickness increase for a long time, thus improving a durability of a resultant liquid crystal device (apparatus).

As described hereinabove, according to the present invention, the translational movement of liquid crystal can be minimized even if a display pattern is changed, thus suppressing an increase in cell thickness with time leading to yellowing or an irregularity in display state in a liquid crystal device. As a result, it is possible to realize a liquid crystal apparatus and a driving method using the liquid crystal device.

The invention may be embodied in other specific forms without departing from the spirit or essential characteristics thereof. The present embodiments and examples are therefore to be considered in all respects as illustrative and not restrictive, the scope of the invention being indicated by the appended claims rather than by foregoing description and all changes which come within the meaning and range of equivalency of the claims are therefore intended to be embraced therein.

What is claimed is:

1. A liquid crystal apparatus, comprising:

a liquid crystal device comprising a pair of substrates respectively having thereon scanning electrodes and data electrodes arranged in a matrix shape, and a liquid crystal disposed between the substrates and capable of causing a cumulative translational movement depending on a change in an external electric field applied to the liquid crystal; and drive means for controlling a first frequency f having a variable range and representing an effective frequency of a drive data signal pulse applied to the liquid crystal so that a second frequency $f_0$ representing an inversion frequency at which a direction of the translational movement of the liquid crystal is turned in an opposite direction is in the variable range of the first frequency f, wherein when said drive data signal pulse includes a drive waveform in a 1H period comprising an even-function waveform, said second frequency $f_0$ and a third frequency $f_1$ satisfies the following relationship:

$$f_1 \leqq f_0 \leqq 1.5 \times f_1,$$

wherein $f_1$ is represented by an equation of $f_1 = y \times 1/(1H)$ where y denotes a natural number satisfying: $z/2 \leqq y \leqq (z+1)/2$ in which z denotes the number of a change in sign of a data signal potential in a 1H period, and (1H) denotes a selection period for one-line writing.

2. A liquid crystal apparatus, comprising:

a liquid crystal device comprising a pair of substrates respectively having thereon scanning electrodes and data electrodes arranged in a matrix shape, and a liquid crystal disposed between the substrates and capable of causing a cumulative translational movement depending on a change in an external electric field applied to the liquid crystal; and drive means for controlling a first frequency f having a variable range and representing an effective frequency of a drive data signal pulse applied to the liquid crystal so that a second frequency $f_0$ representing an inversion frequency at which a direction of the translational movement of the liquid crystal is turned in an opposite direction is in the variable range of the first frequency f, wherein when said drive data signal pulse includes a drive waveform in a 1H period comprising an odd-function waveform, said second frequency $f_0$ and a third frequency $f_1$ satisfies the following relationship:

$$0.5 \times f_1 \leqq f_0 \leqq f_1,$$

wherein f, is represented by an equation of $f_1 = y \times 1/(1H)$ where y denotes a natural number satisfying: $z/2 \leqq y \leqq (z+1)/2$ in which z denotes the number of a change in sign of a data signal potential in a 1H period, and 1H) denotes a selection period for one-line writing.

3. A liquid crystal apparatus, comprising:

a liquid crystal device comprising a pair of substrates respectively having thereon scanning electrodes and data electrodes arranged in a matrix shape, and a liquid crystal disposed between the substrates and capable of causing a cumulative translational movement depending on a change in an external electric field applied to the liquid crystal; and drive means for controlling a first frequency f having a variable range and representing an effective frequency of a drive data signal pulse applied to the liquid crystal so that a second frequency $f_0$ representing an inversion frequency at which a direction of the translational movement of the liquid crystal is turned in an opposite direction is in the variable range of the first frequency f, wherein said second frequency $f_0$ and a third frequency f satisfies the following relationship:

$$0.5 \times f_1 \leqq f_0 \leqq 1.5 \times f_1,$$

wherein $f_1$ is represented by an equation of $f_1 = y \times 1/(1H)$ where y denotes a natural number satisfying: $z/2 \leqq y \leqq (z+1)/2$ in which z denotes the number of a change in sign of a data signal potential in a 1H period, and (1H) denotes a selection period for one-line writing.

4. An apparatus according to any one of claims 1–3, wherein said liquid crystal assumes a chiral smectic phase.

5. A driving method for a liquid crystal device of the type comprising a pair of substrates respectively having thereon scanning electrodes and data electrodes arranged in a matrix shape, and a liquid crystal disposed between the substrates and capable of causing a cumulative translational movement depending on a chance in an external electric field applied to the liquid crystal; said driving method comprising:

controlling a first frequency f having a variable range and representing an effective frequency of a drive data signal pulse applied to the liquid crystal so that a second frequency $f_0$ representing an inversion frequency at which a direction of the translational movement of the liquid crystal is turned in an opposite direction is in the variable range of the first frequency f, wherein when said drive data signal pulse includes a drive waveform in a 1H period comprising an even-function waveform, said second frequency $f_0$ and a third frequency $f_1$ satisfies the following relationship:

$$f_1 \leqq f_0 \leqq 1.5 \times f_1,$$

wherein $f_1$ is represented by an equation of $f_1 = y \times 1/(1H)$ where y denotes a natural number satisfying: $z/2 \leqq y \leqq (z+1)/2$ in which z denotes the number of a change in sign of a data signal potential in a 1H period, and (1H) denotes a selection period for one-line writing.

6. A driving method for a liquid crystal device of the type comprising a pair of substrates respectively having thereon scanning electrodes and data electrodes arranged in a matrix shape, and a liquid crystal disposed between the substrates and capable of causing a cumulative translational movement depending on a change in an external electric field applied to the liquid crystal; said driving method comprising:

controlling a first frequency f having a variable range and representing an effective frequency of a drive data signal pulse applied to the liquid crystal so that a second frequency $f_0$ representing an inversion frequency at which a direction of the translational movement of the liquid crystal is turned in an opposite direction is in the variable range of the first frequency f, wherein when said drive data signal pulse includes a drive waveform in a 1H period comprising an odd-function waveform, said second frequency $f_0$ and a third frequency $f_1$ satisfies the following relationship:

$$0.5\times f_1 \leqq f_0 \leqq f_1,$$

wherein $f_1$ is represented by an equation of $f_1=y\times 1/(1H)$ where y denotes a natural number satisfying: $z/2 \leqq y \leqq (z+1)/2$ in which z denotes the number of a change in sign of a data signal potential in a 1H period, and (1H) denotes a selection period for one-line writing.

7. A driving method for a liquid crystal device of the type comprising a pair of substrates respectively having thereon scanning electrodes and data electrodes arranged in a matrix shape, and a liquid crystal disposed between the substrates and capable of causing a cumulative translational movement depending on a change in an external electric field applied to the liquid crystal; said driving method comprising:

controlling a first frequency f having a variable range and representing an effective frequency of a drive data signal pulse applied to the liquid crystal so that a second frequency $f_0$ representing an inversion frequency at which a direction of the translational movement of the liquid crystal is turned in an opposite direction is in the variable range of the first frequency f, wherein said second frequency $f_0$ and a third frequency $f_1$ satisfies the following relationship:

$$0.5\times f_1 \leqq f_0 \leqq 1.5\times f_1,$$

wherein $f_1$ is represented by an equation of $f_1=y\times 1/(1H)$ where y denotes a natural number satisfying: $z/2 \leqq y \leqq (z+1)/2$ in which z denotes the number of a change in sign of a data signal potential in a 1H period, and (1H) denotes a selection period for one-line writing.

* * * * *

UNITED STATES PATENT AND TRADEMARK OFFICE

CERTIFICATE OF CORRECTION

PATENT NO. : 5,999,157

DATED : December 7, 1999

INVENTOR(S) : NOBUHIRO ITO , ET AL.

It is certified that error appears in the above-identified patent and that said Letters Patent is hereby corrected as shown below:

On the title page:

[56] References Cited

Foreign Patent Document
"5273537" should read --52-73537--;

Column 1

Line 38, "shows" should read --show--;
Line 47, "m any" should read --many--;
Line 62, "from" should be deleted;

Column 2

Line 11, "of" should read --of the--;
Line 42, "(phenomenon"). should read --phenomenon").--;

Column 4

Line 27, "an" should read --and--;

UNITED STATES PATENT AND TRADEMARK OFFICE

CERTIFICATE OF CORRECTION

PATENT NO. : 5,999,157

DATED : December 7, 1999

INVENTOR(S) : NOBUHIRO ITO , ET AL.

It is certified that error appears in the above-identified patent and that said Letters Patent is hereby corrected as shown below:

Column 5

Line 2, " a shown" should read --as shown--;
Line 30, " change" should read --changes--;

Column 6

Line 65, "$_{(f1}$ : third " should read --($F_1$: Third--;

Column 7

Line 8, "division" should read --divisions--;
Line 28, "a" should be deleted;
Line 55, "prefer ably" should read --preferably--;

Column 8

Line 31, "a a" should read --as a--;
Line 47, "o" should read --of--;

UNITED STATES PATENT AND TRADEMARK OFFICE

CERTIFICATE OF CORRECTION

PATENT NO. : 5,999,157

DATED : December 7, 1999

INVENTOR(S) : NOBUHIRO ITO , ET AL.

Column 10

Line 30, "direction" should read --directions--;
Line 49, "of" should read --of the--;

Column 11

Line 5, "prepare" should read --prepared--;
Line 49, "an" should read --to an--;
Line 58, "an" should read --to an--;

Column 12

Line 10, "an" should read --to an--;
Line 20, "an" should read --to an--;
Line 30, "an" should read --to an--;

UNITED STATES PATENT AND TRADEMARK OFFICE

CERTIFICATE OF CORRECTION

PATENT NO. : 5,999,157

DATED : December 7, 1999

INVENTOR(S) : NOBUHIRO ITO , ET AL.

It is certified that error appears in the above-identified patent and that said Letters Patent is hereby corrected as shown below:

Column 13

Line 60, "1H)" should read --(1H)--;

Column 14

Line 11, "f" should read --$f_1$--;

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*